United States Patent [19]

Livemore

[11] 4,389,222

[45] Jun. 21, 1983

[54] GAS PRODUCER APPARATUS

[76] Inventor: Gerald S. V. Livemore, 121 Holt St., Parkmore, Transvaal, South Africa

[21] Appl. No.: 174,286

[22] Filed: Jul. 31, 1980

[51] Int. Cl.[3] ..... C10J 3/28

[52] U.S. Cl. ..... 48/76; 48/87; 422/110

[58] Field of Search ..... 48/76, 87, 67, 68, 69; 266/144; 422/110

[56] References Cited

U.S. PATENT DOCUMENTS 1,023,567 4/1912 Huttinger ..... 48/67

1,758,991 5/1930 Willis ..... 48/87

1,865,929 7/1932 Leahy ..... 48/87

FOREIGN PATENT DOCUMENTS 164548 6/1921 United Kingdom ..... 48/76

*Primary Examiner*—Peter F. Kratz

*Attorney, Agent, or Firm*—Marvin A. Naigur; John E. Wilson; John J. Herguth, Jr.

[57] ABSTRACT

A gas producer for coal gasification in which the gas collecting flues are provided with means for flow rate determination and adjustable flow restriction.

8 Claims, 4 Drawing Figures

GAS PRODUCER APPARATUS

This invention relates to two stage gas producing plants which are used for the production of gas from coal or any other fuel suitable for gasification.

Two stage gas producers are known in the trade and generally these comprise an elongated cylindrical structure comprising an upper section of refractory material, a water jacket disposed immediately below the upper section and a seal skirt extending from the lower end of the water jacket. In this specification the upper section of refractory material will be referred to as the wall of the producer.

Inside the water jacket a conical grate, which may be rotatable, is disposed and in use an air and steam mixture is fed into the producer via the grate. Coal is fed into the producer from one or more bunkers disposed at the upper extremity of the wall of the producer. The rate at which the air and steam mixture is fed into the producer is adjusted such that a firebed, which is formed in the coal, is disposed approximately halfway between the ends of the water jacket.

Two gas fractions are separated in two stage producers namely the bottom gas, i.e. the gas which is collected relatively close to the firebed and the top gas, i.e. the fraction which is collected at or towards the upper extremity of the producer.

It is known to collect the bottom gas through the agency of a plurality of evenly spaced flues which are disposed inside the wall of the producer. The inlets of these flues are normally disposed adjacent the mating region of the wall of the producer and the water jacket. This region of the producer also commonly houses a number of poke holes. The upper section of two stage producers are in addition also normally provided with transverse partitions containing flues similar to those disposed in the cylindrical wall of the producer. The flues are normally arranged to discharge into an annular collecting duct disposed in the circular wall towards the upper extremity thereof and a common gas take off conduit extends from the collecting duct.

One of the factors influencing the optimal production of gas in a two stage producer is the uniformity of gas flow through the producer. Ideally, there should be a uniform flow of gas through any horizontal plane in the producer. In some producers of the kind discussed, a tendency of draught formation towards the final gas take of conduit is sometimes experienced. Clinker formation in the fire zone also results in uneven gas flow through the producer.

In the gas producing process it is also advantageous for the coal to settle down the producer at a uniform rate. In known producers including a pair of intersecting internal partitions the coal located in the corner zones settle more slowly than those which are not in direct contact with the producer walls. This results in part of the coal being subjected for longer periods to the gassification process.

Producers of the kind discussed above can also, as a rule, accommodate only coal of a swelling number below a certain minimum.

It is an object of this present invention at least to minimise some of the disadvantages of known gas producers.

According to the invention a gas producer including a plurality of gas collecting flues is characterised in that at least some of the gas collecting flues have associated with them a flow rate determining means and an adjustable flow restricting means.

In one application of the invention each of the flues in a set of flues may be provided with a separate flow rate determining means and/or a separate flow restricting means. Preferably, however, small groups of neighbouring flues may be provided with a common flue rate determining means and/or a common flow restricting means.

In one application of the invention the producer comprises a plurality of flues located in the wall thereof and groups of neighbouring flues may be arranged to discharge into a common sub-collecting chamber. The sub-collecting chambers may in turn be arranged to discharge into a common collecting duct which in turn communicates with the gas take-off conduit.

The flow rate determining means may comprise a flow meter. As it has been found that the temperature in the flue is substantially proportional with the rate of flow through the flue, a thermometer may be used as a flow rate determining means. It is further preferred to use a thermocouple as thermometer.

The flow restricting means may comprise dampers.

In the preferred embodiment of the invention the flues in the wall of the producer are divided into eight groups and each group is provided with a sub-collecting chamber which is provided with a discharge aperture through which gas may be discharged from the sub-collecting chamber to a common collecting conduit. Each sub-collecting chamber is in addition provided with a thermocouple and the discharge aperture of the sub-collecting chamber is provided with a damper which is adapted to occlude the discharge aperture.

Further according to the invention a method of balancing the gas flow in a gas producer of the kind in question comprises the steps of determining the rate of flow in at least some of a plurality of gas collecting flues and adjusting flow restricting means which are provided in association with the flues to attain a substantially equal rate of flow in all of the flues.

The rate of flow of the gas in the flue may be determined by means of a flow meter. Preferably the flow rate is determined by means of a thermometer such as a thermocouple. The adjustment of the flow restricting means may be either manual or automatic.

According to another aspect of the present invention a gas producer comprising a cylindrical side wall including a plurality of gas collecting flues are characterised by an additional collecting flue comprising a pipe formation disposed centrally of the producer and having an inlet opening disposed at substantially the same level as the inlet openings of the collecting flues contained in the side wall.

Preferably the inlet opening to the central flue is co-axial with the flue. The flue may preferably be arranged to discharge into the common collecting conduit into which the flues contained in the side wall discharge. Preferably the central flue discharges into the collecting conduit via a manifold arrangement.

Preferably each of the outlets of the manifold include flow rate determining means and flow restricting means similar to those described above.

The arrangement is preferably such that the manifold also acts as a support from which the central flue is suspended.

Further according to this aspect of the present invention the central flue may be rotatably mounted in the producer. Thus the manifold structure may constitute a stationary support for the rotating flue.

The central flue may be rotated via a drive shaft by means of an overhead ratchet wheel and pneumatic or hydraulic ram assembly.

Preferably the rotating central flue is provided with rabble arms which are arranged to pass through the coal on rotation. The rabble arms may be wedge-shaped when viewed in cross section to assist the motion thereof through the coal.

Means may be provided whereby the bearing region between the central flue and its support may be cooled.

Referring to the accompanying drawings a preferred embodiment of the invention will now be described without thereby limiting the scope of the invention.

In the accompanying drawings.

In the accompanying drawings the same reference numerals denote the same components in the various figures.

Figure 1:
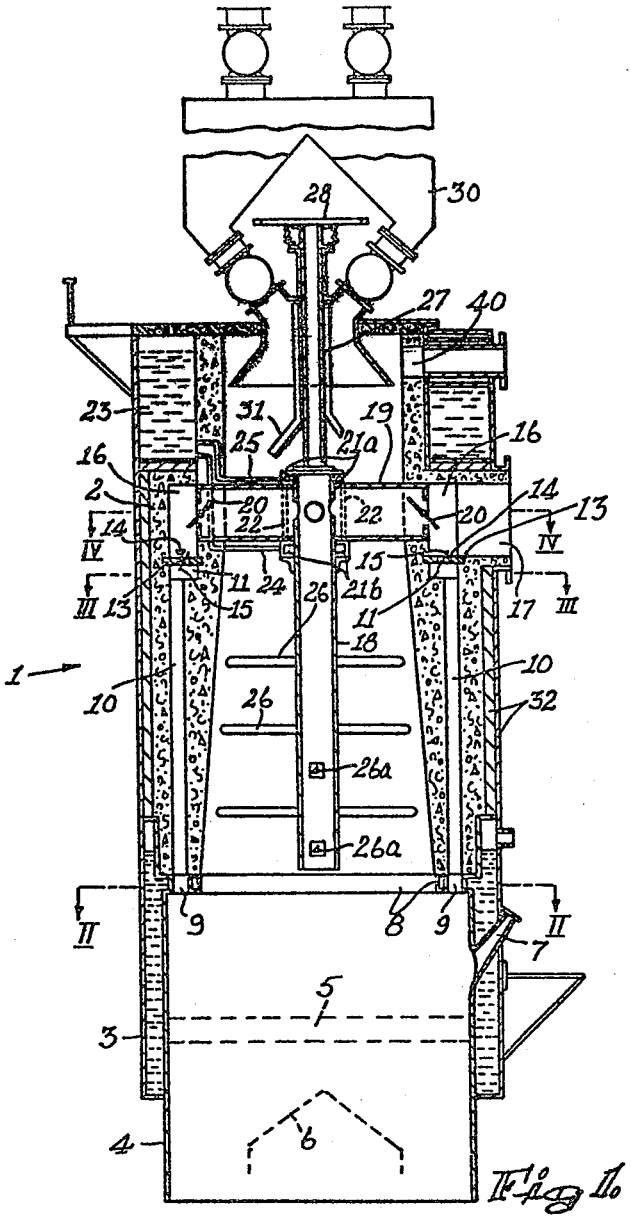
FIG. 1 is a schematic sectional elevation of a gas producer according to the invention.
Figure 2:
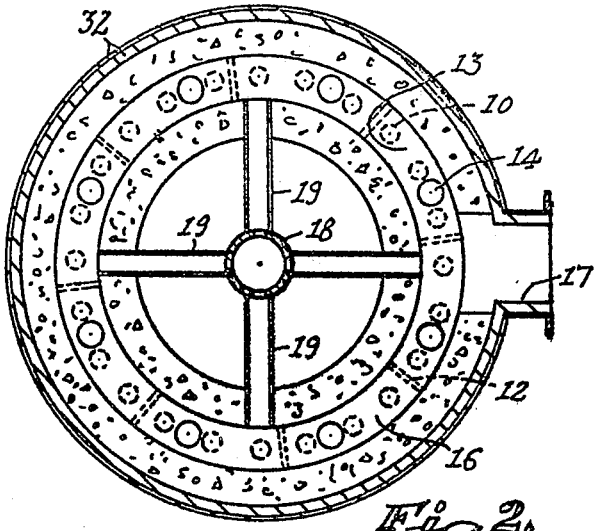
FIG. 2 is a cross section on line IV—IV of FIG. 1.
Figure 3:
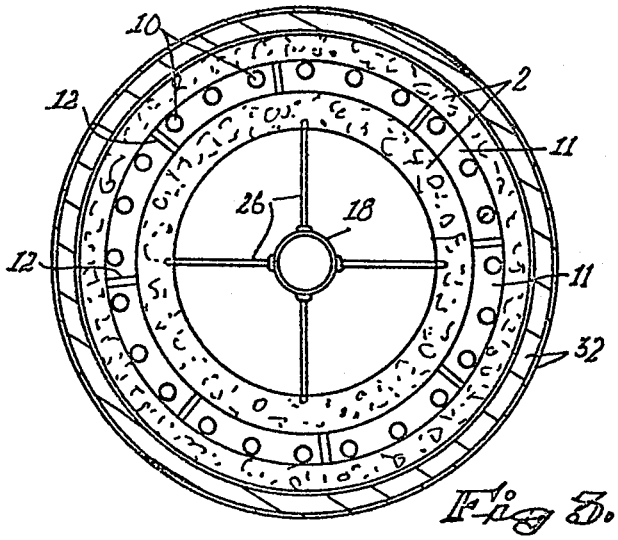
FIG. 3 is a cross section on line III—III of FIG. 1.

Referring to the accompanying drawings a gas producer 1 having an outer casing comprising a wall 2 of refractory material. The refractory material may either comprise bricking or may be castable refractory material. Disposed at the lower end of the wall 2 is a water jacket 3 with a seal skirt 4. The water jacket 3 and seal skirt 4 are both of metal. The water jacket 3 shown in FIG. 1, is of novel construction and is described in more detail in our co-pending patent application Ser. No. 174,283 filed on even date herewith entitled "Improvements in or relating to Gas producers-B".

The fire zone 5 is shown by broken lines intermediate the ends of the water jacket 3 and so is also the grate 6 through which an air and steam mixture is fed into the producer 1.

The water jacket 3 is provided with twelve poke holes 7 (only one of which is shown) and an internal collar 8 through which there are provided twenty four apertures 9 which in use constitute the inlets to the bottom gas collecting flues.

Figure 4:
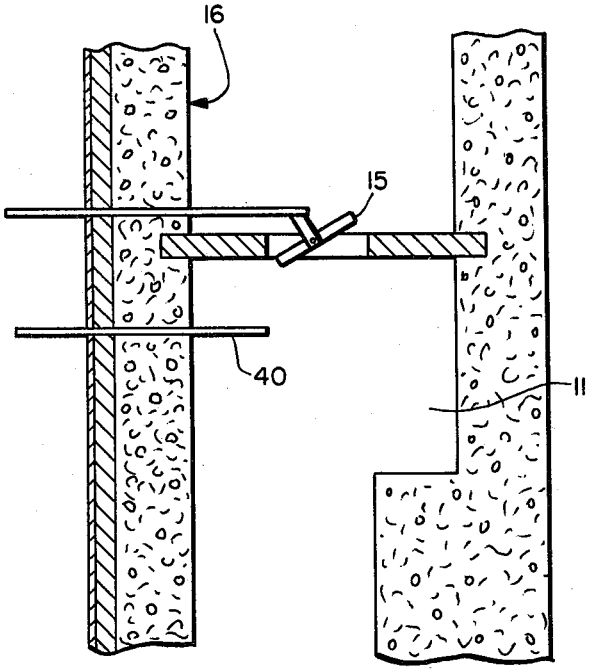
FIG. 4 is a fragmentary view, partly in section, showing in enlarged scale the structure immediately above one of the flues of FIG. 1.

Twenty four flues 10 are defined in the wall 2 and the upper extremities of these are in communication with an enlarged sub-collecting chamber 11 which is constituted by an annular passage in the wall 2 which passage is divided up into eight segements by means of devider plates 12. The top of the chamber 11 is constituted by a slab 13. The slab 13 is provided with eight equally spaced apertures 14 which are arranged so that each chamber 11 has an aperture 14 associated with it. Each aperture 14 is provided with a damper 15 (see FIG. 4). A thermometer in the form of a thermocouple 40 is disposed within each of the chambers 11.

A common collecting conduit 16 is disposed above the slab 13 and is also in the form of an annular passage in the wall 2. Leading from the common collecting conduit 16 is a gas take off duct 17.

In use the flow of gas via flues 10 may be balanced by adjusting the dampers 15 to obtain substantially equal readings from the thermocouples. Equal flow through the flues 10 would in turn result in substantially equal flow of gas within the coal. Also should undesirable fire conditions, such as clinker formation set in, the fire zone 5, this will have an influence on the flow through the flues, and remedial action, such as poking the fire may be taken before the clinker had formed to such an extent that harsh action or shut-down is required.

It will be appreciated that adjustment to the dampers may be effected either manually or automatically.

The gas producer 1 also includes a central flue 18 of spuncast or stainless steel tubing which is suspended from its upper end by means of a support structure 19 which also constitutes a manifold comprising four outlets through which the gas collected by flue 18 is discharged into the collecting conduit 16. At their delivery ends the outlets of the manifold arrangement 20 include dampers 20 and thermocouples (not shown) are also disposed in these outlets. By adjusting the dampers 20 a flow balance may be achieved between the gas flow through flues 10 and that through flue 18.

The central flue 18 is rotatably mounted on the support structure 19 and the bearing surfaces are water-cooled by means of a pair of tubes 21(*a*) and 21(*b*) which are in fluid connection via tubes 22. The cooling system is fed from a water tank 23 carried at the upper region of the wall 2 via a feed tube 24 and a return tube 25. The flow in the cooling system is purely by way of convection but it will be appreciated that suitable pump means may be provided if required.

The central flue 18 is further provided with a plurality of rabble arms 26 which are wedge shaped in cross section as is indicated at 26 (*a*).

The central flue is rotated via a drive shaft 27 by means of a ratchet wheel 28 and hydraulic or pneumatic ram arrangements (not shown).

Coal is fed into the producer from the bunkers 30 and a deflector arrangement 31 is provided for preventing coal from coming into contact with the bearing surfaces between the support structure 19 and the revolving flue 18.

Isolation material 32 may be provided around the outer periphery of wall 2.

With the producer according to the invention there is provided a means by which gas flow may be balanced thus increasing the effectiveness of gas production. Furthermore there are less restructions in the upper zone of the producer giving the producer a greater effective capacity and furthermore, the substantial absence of corners allows for better settling of coal down the producer which again improves the production of gas. Another advantage of the present invention is that due to the rotatable rabble arms the producer can accommodate coal of a higher swelling number or smaller dimensions that what can be used in comperable producers not including a rotatable rabble arm system.

Clearly many variations of detail may be thought of without thereby departing from the spirit of the invention. Thus, for example, the top gas take off conduit 40 may likewise be modified to include a plurality of flues containing flow rate detecting means and flow restricting means.

What is claimed is:

1. A substantially vertical cylindrical gas producer including a plurality of vertical circumferentially spaced flues in the wall of the producer, each of the said flues being open at its lower end for conveying product gas upwardly; and means for dividing the flues into approximately eight groups and providing each group with a sub-collecting chamber which is further provided with a discharge aperture through which gas may be discharged from the sub-collecting chamber to a common collecting conduit for the groups of flues, the means for dividing, subcollecting chambers, discharge apertures and common collecting conduit being located in the wall of the producer and wherein each sub-collecting chamber is provided with a thermocouple for determining the gas temperature within the associated sub-collecting chamber and wherein the discharge aperture of the sub-collecting chamber is provided with an adjustable damper which is arranged to balance gas flow through the discharge aperture.

2. A substantially vertical cylindrical gas producer comprising an outer casing, the outer casing being suitable for containing in its lower portion a fire zone, a plurality of upwardly extending circumferentially spaced flues inside the producer, each of said flues having an open lower end in communication with the fire zone to allow product gas to enter, and pass upwardly, a common collecting conduit communicating with each of said flues, a plurality of flow rate detecting means, each receiving product gas from at least one of said flues and a plurality of flow regulating means for regulating the flow from at least one of said flues, said flow regulating means and said flow rate detecting means being positioned between said flues and said common collecting chamber so that said flow rate regulating means may be actuated so that the flow rate in each of said flues is substantially equal.

3. A producer according to claim 2 including groups of neighbouring flues which are arranged to discharge into a common sub-collecting chamber.

4. The producer of claim 3 wherein the sub-collecting chamber is arranged to discharge into a common collecting duct which in turn communicates with a gas take-off conduit.

5. The producer of claim 2 to wherein the flow rate detecting means comprises a thermometer.

6. The producer of claim 5 wherein a thermocouple is used as a thermometer.

7. The producer of claim 6 wherein the flow regulating means comprise dampers.

8. A gas producer according to claim 2 wherein said flues are located in the walls of said producer.

* * * * *